US009361849B2

(12) United States Patent
Park et al.

(10) Patent No.: US 9,361,849 B2
(45) Date of Patent: Jun. 7, 2016

(54) DATA DRIVING APPARATUS FOR LIQUID CRYSTAL DISPLAY DEVICE HAVING A CONTROL SWITCH FOR PRECHARGING AN OUTPUT CHANNEL

(71) Applicant: LG DISPLAY CO., LTD., Seoul (KR)

(72) Inventors: Sung-Gon Park, Daegu (KR); Joo-Hong Lee, Seoul (KR); Woong-Ki Min, Paju-si (KR); Yoon-San Park, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/319,562

(22) Filed: Jun. 30, 2014

(65) Prior Publication Data

US 2015/0002503 A1 Jan. 1, 2015

(30) Foreign Application Priority Data

Jun. 29, 2013 (KR) ..... 10-2013-0076157

(51) Int. Cl.
*G09G 3/36* (2006.01)

(52) U.S. Cl.
CPC ..... *G09G 3/3696* (2013.01)

(58) Field of Classification Search
CPC ..... G09G 3/3696
USPC ..... 345/96, 209, 212
See application file for complete search history.

(56) References Cited

U.S. PATENT DOCUMENTS

2003/0160749 A1* 8/2003 Tsuchi ..... G09G 3/2011 345/87
2005/0057481 A1 3/2005 Chung
2006/0050037 A1* 3/2006 Maki ..... G09G 3/3688 345/89
2006/0125759 A1 6/2006 An
2007/0126722 A1* 6/2007 Hashimoto ..... G09G 3/3685 345/204
2008/0174462 A1* 7/2008 Tsuchi ..... G09G 3/3614 341/144
2011/0148893 A1* 6/2011 An ..... G09G 3/3614 345/545

FOREIGN PATENT DOCUMENTS

CN 1598905 A 3/2005
CN 101887698 A 11/2010

* cited by examiner

*Primary Examiner* — Long D Pham
(74) *Attorney, Agent, or Firm* — Birch, Stewart, Kolasch & Birch, LLP

(57) ABSTRACT

A data driving apparatus for a liquid crystal display device includes an output buffer for buffering and outputting a data voltage input from a digital-analog converter, wherein the output buffer includes an input amplifier for amplifying and outputting current proportional to the data voltage, an outputter for supplying a data voltage corresponding to the input data voltage to an output channel using charging and discharging current proportional to output current from the input amplifier, a control switch unit connected between the input amplifier and the outputter, for driving the outputter in a switching mode to precharge the output channel in a precharge period prior to a data supplying period in which the outputter outputs the data voltage, and a mode controller for controlling the control switch unit in response to an input control signal.

7 Claims, 8 Drawing Sheets

<TEMPERATURE DIFFERENCE PER 55"
120Hz SOLID GRAY (APPLY CHARGE SHARE)>

DATA DRIVING APPARATUS FOR LIQUID CRYSTAL DISPLAY DEVICE HAVING A CONTROL SWITCH FOR PRECHARGING AN OUTPUT CHANNEL

This application claims the benefit of Korean Patent Application No. 10-2013-0076157, filed on, Jun. 29, 2013, in the Republic of Korea, which is hereby incorporated by reference as if fully set forth herein.

BACKGROUND OF THE INVENTION

1. Field of the Invention

The present invention relates to a liquid crystal display device, and more particularly, to a data driving apparatus for a liquid crystal display device for reducing a heating value of a driver integrated circuit (IC).

2. Discussion of the Related Art

Representative examples of a flat display apparatus for displaying an image using digital data include a liquid crystal display (LCD) device using liquid crystal, a plasma display panel (PDP) using discharge of inert gas, a organic light emitting diode (OLED) display device using an OLED, and the like. Among these, the LCD device has been widely used in various application fields such as in a television (TV), a monitor, a notebook computer, and a portable phone.

An LCD device displays an image through a pixel matrix using the electrical and optical properties of liquid crystal having anisotropic properties with respect to refractive index, dielectric constant, and the like. Each pixel of the LCD device implements a gray level by adjusting optical transmittance with respect to a polarization plate using variation in liquid crystal arrangement direction according to a data signal. The LCD device includes a liquid crystal panel for displaying an image through the pixel matrix, a gate driver and data driver for driving the liquid crystal panel, a backlight unit for irradiating light to the liquid crystal panel, and a backlight driver for driving the backlight unit.

A high resolution and large size LCD device has been developed. Accordingly, a driving frequency and load amount of a drive integrated circuit (IC) for supplying a data voltage to a liquid crystal panel needs to be increased and a positive data voltage and a negative data voltage need to be swing for inversion driving of the liquid crystal panel, and thus, a heating value of the drive IC has been increased. When a temperature of the drive IC increases, reliability of the drive IC is degraded and a safety hazard such as ignition is caused. Accordingly, there is a need to lower the temperature of the drive IC.

In general, an output buffer for buffering a data signal from a digital-analog converter (DAC) to a drive IC and outputting the data signal to a data line is a most power-consumed component, the output buffer acts as a main heating source of the drive IC. Accordingly, there is a need for a method of reduce output current of the output buffer in order to reduce a heating value of the drive IC.

SUMMARY OF THE INVENTION

Accordingly, the present invention is directed to a data driving apparatus for a liquid crystal display device that substantially obviates one or more problems due to limitations and disadvantages of the related art.

An object of the present invention is to provide a data driving apparatus for a liquid crystal display device for reducing output current of an output buffer to reduce a temperature of a drive integrated circuit (IC).

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a data driving apparatus for a liquid crystal display device includes an output buffer for buffering and outputting a data voltage input from a digital-analog converter, wherein the output buffer includes an input amplifier for amplifying and outputting current proportional to the data voltage, an outputter for supplying a data voltage corresponding to the input data voltage to an output channel using charging and discharging current proportional to output current from the input amplifier, a control switch unit connected between the input amplifier and the outputter, for driving the outputter in a switching mode to precharge the output channel in a precharge period prior to a data supplying period in which the outputter outputs the data voltage, and a mode controller for controlling the control switch unit in response to an input control signal.

The outputter may include a first output transistor for forming a charging path between a first voltage and the output channel; and a second output transistor for forming a discharging path between a second voltage lower than the first voltage and the output channel, and the control switch unit may include a first control switch connected between first and second output lines of the input amplifier and a gate of the first and second output transistors, for connecting the input amplifier and the outputter in the data supplying period, a second control switch connected between the first voltage and a gate of the first output transistor and between the first voltage and a gate of the second output transistor, for controlling the first and second output transistors so as to precharge the output channel through the charging path in the precharge period, and a third control switch connected between the second voltage and a gate of the first output transistor and between the second voltage and a gate of the second output transistor, for controlling the first and second output transistors so as to precharge the output channel through the discharging path in the precharge period.

The data driving apparatus may further include a timing controller for analyzing data to be supplied to the output channel per output channel, and generating and outputting the control signal for controlling the switching mode of the outputter according to whether a difference in a data voltage level is present or the data voltage level satisfies a specific gray scale condition per output channel.

The mode controller may turn off the switching mode of the outputter when the control signal indicates that the difference in the data voltage level is not present, and turn on the switching mode of the outputter when the control signal indicates that the difference in the data voltage level is present.

The outputter may be controlled to precharge the output channel via overshooting using the first voltage or undershooting using the second voltage when the control signal indicates that the difference in data voltage level is present and a gray scale of data to be supplied to the output channel is a specific gray scale or more.

The outputter may be controlled to precharge the output channel with any one of gray scale voltages supplied through the input amplifier when the control signal indicates that the difference in data voltage level is present and a gray scale of data to be supplied to the output channel is a gray scale less than the specific gray scale.

The timing controller may generate and output first and second enable signals, the first control switch may supply a gray scale voltage from the input amplifier to the outputter in a disable period of the first output enable signal, and the second or third control switch may precharge the output channel with the gray scale voltage supplied from the input amplifier in a disable period of the second output enable signal.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
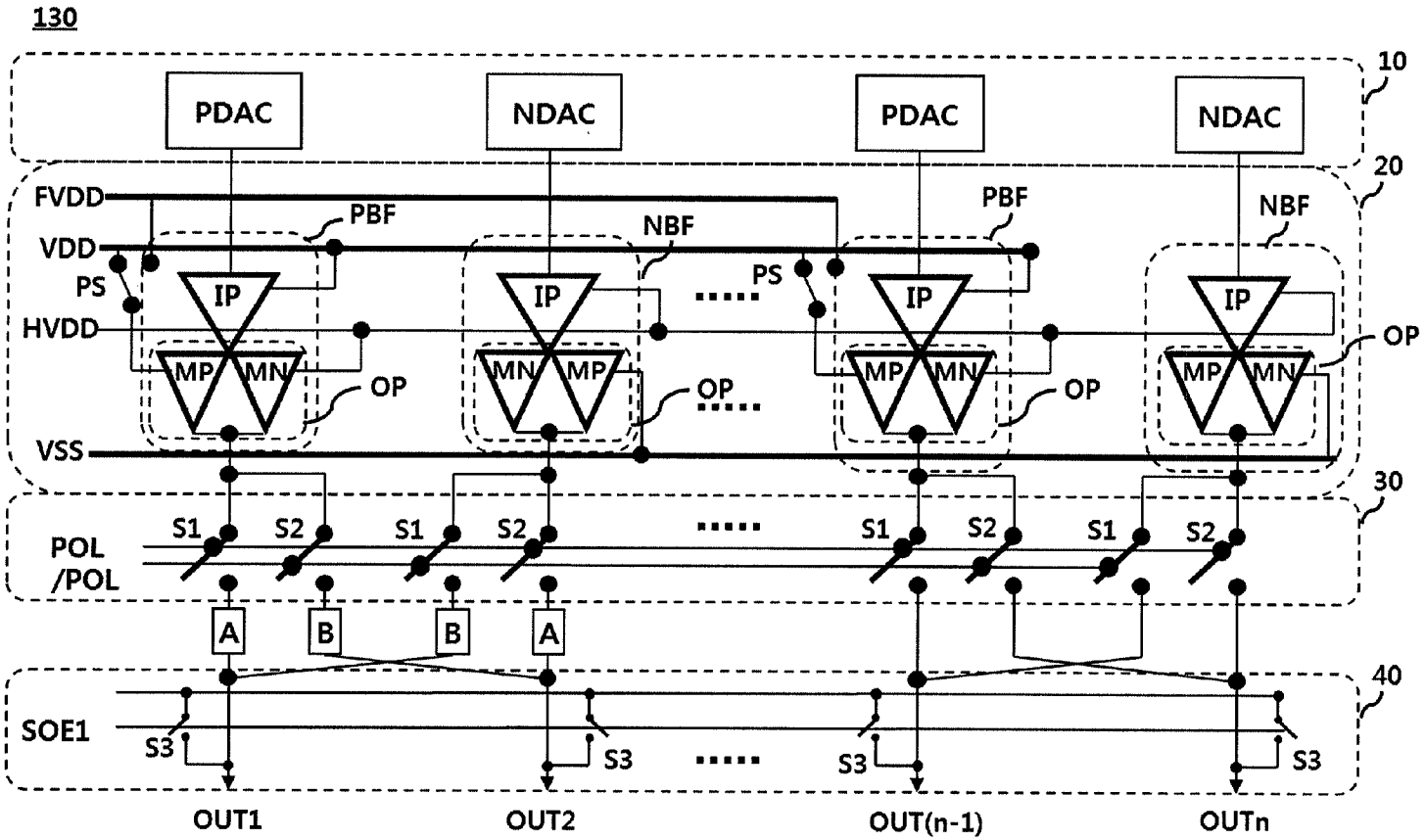
FIG. 1 is an equivalent circuit diagram illustrating a portion of a data driver of a liquid crystal display device according to an embodiment of the present invention.

FIG. 1 is a circuit diagram illustrating a portion of a data driver of a liquid crystal display device according to an embodiment of the present invention. All the components of the liquid crystal device are operatively coupled and configured.

Referring to FIG. 1, the data driver includes a digital-analog converter (DAC) unit 10, an output buffer 20, a multiplexer (MUX) 30, and a charge sharing unit 40. In addition, the data driver further includes a shift register (not shown) at an input terminal of the DAC unit 10, a latch unit (not shown) that latches input digital data according to control of the shift register and outputs the digital data to the DAC unit 10, a gamma voltage generator (not shown) for generating and outputting positive and negative gamma voltages corresponding to each gray scale of digital data, etc.

The DAC unit 10 includes a positive-DAC (PDAC) for converting input data to a positive data signal using a positive gamma voltage (a gamma high voltage) and a negative-DAC (NDAC) for converting input data into a negative data signal using a negative gamma voltage (a gamma low voltage). The PDAC and the NDAC are alternately arranged and correspond to respective data channels.

The output buffer 20 includes a positive output buffer PBF for buffering and outputting the positive data signal supplied from the PDAC and a negative output buffer NBF for buffering and outputting the negative data signal supplied from the NDAC. The positive output buffer PBF and the negative output buffer NBF are alternately arranged and correspond to respective data channels.

Each of the positive and negative output buffers PBF and NBF includes an input amplifier IP and an outputter OP and further include a mode controller (not shown) and a control switcher (not shown) for control of the outputter OP in a switching mode for precharging. The positive output buffer PBF to the input amplifier IP are connected to a first high level voltage VDD, and the outputter OP includes output transistors MP and MN connected between the first high level voltage VDD or a second high level voltage FVDD and a middle level voltage HVDD. The negative output buffer PBF to the input amplifier IP are connected to the middle level voltage HVDD, and the outputter OP includes output transistors MP and MN connected between the middle level voltage HVDD and a low level voltage VSS.

The outputter OP of each of the positive output buffer PBF and the negative output buffer NBF may function as a unit gain amplifier in a data supply period and perform a switching operation in a precharge period according to whether a data level per channel varies to precharge an output line prior to the data supply period.

When a voltage level of data supplied to a corresponding data line in a previous horizontal period and a voltage level of data to be supplied to the corresponding data line in a current horizontal period are the same or similar, a switching mode of the outputter OP is off such that the corresponding outputter OP does not perform unnecessary precharging. On the other hand, when voltage levels of the previous data and the current data are different or are not similar, the corresponding outputter OP operates in a switching mode to perform precharging. In this case, a precharge voltage may vary according to a data condition.

Figure 2:
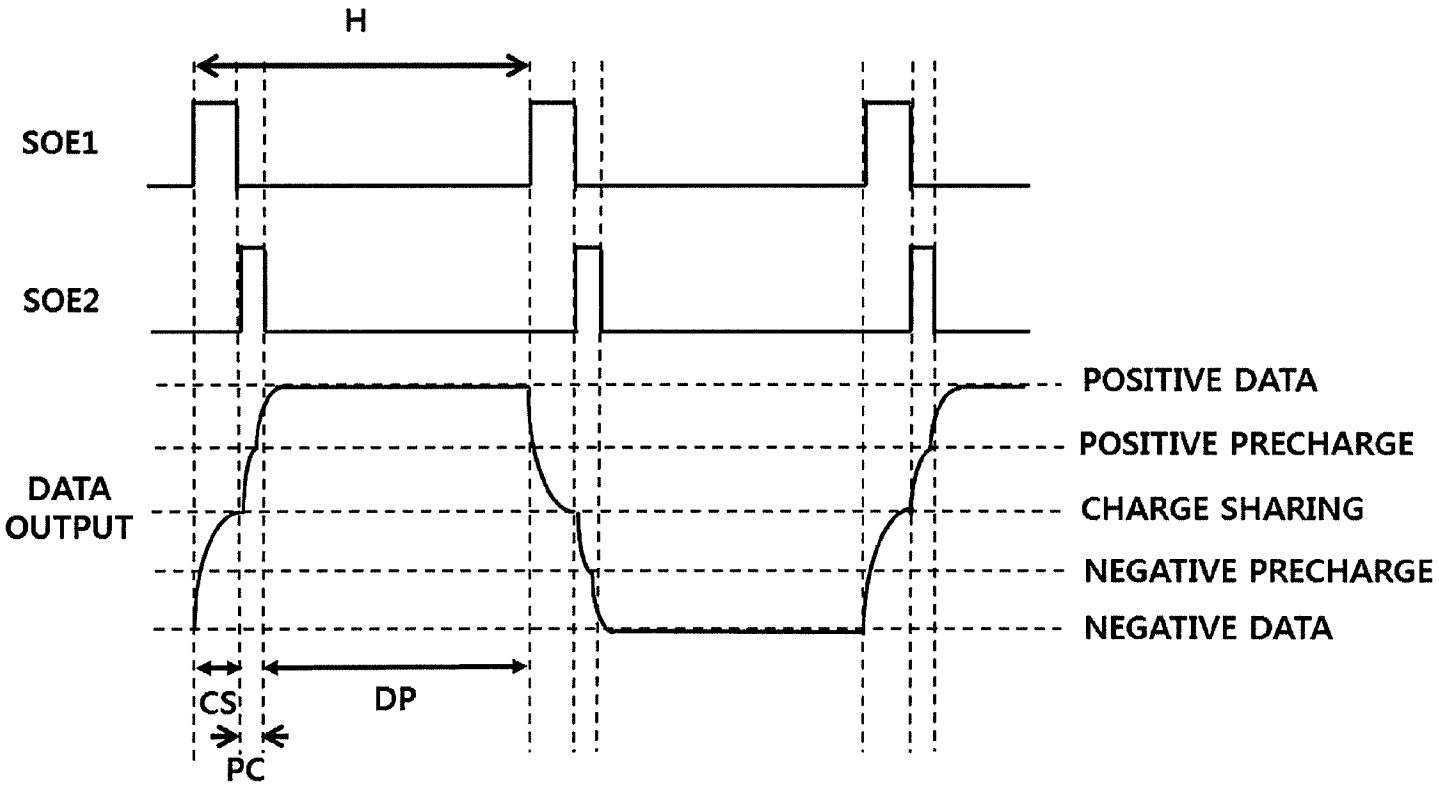
FIG. 2 is an example of a driving waveform diagram of the data driver illustrated in FIG. 1.

Referring to FIG. 2, in each horizontal period H, a precharge period PC of the positive and negative output buffers PBF and NBF is positioned between a charge sharing period CS and a data supplying period DP. The charge sharing period CS of the charge sharing unit 40 is set according to a disable period of a first source output enable signal SOE1 and the precharge period PC is set according to a disable period of a second source output enable signal SOE2.

In FIG. 1, a power switch PS selectively connects the first high level voltage VDD or the second high level voltage FVDD higher than the first high level voltage VDD to the outputter OP of the positive output buffer PBF in response to a mode control signal of a corresponding channel.

For example, the power switch PS may connect the second high level voltage FVDD to the outputter OP of the positive output buffer PBF for precharge via overshooting in the precharge period PC illustrated in FIG. 2 and connect the first high level voltage VDD to the outputter OP of the positive output buffer PBF in the remaining period.

The MUX 30 selects an output path of the positive output buffer PBF and the negative output buffer NBF in response to a polarity control signal POL. The MUX 30 connects an output line of the positive output buffer PBF to one of two adjacent output channels A and B and connects an output line of the negative output buffer NBF to the other one channel in response to the polarity control signal POL. To this end, the MUX 30 includes first and second switches S1 and S2 that are connected to the two adjacent output channels A and B for the output lines of the positive and negative output buffers PBF and NBF, respectively and the first and second switches S1 and S2 are controlled by the polarity control signal POL and a reverse polarity control signal/POL, respectively.

The charge sharing unit 40 includes a third switch S3 controlled by the first source output enable signal SOE1 and short-circuits all output channels OUT1 to OUTn in the charge sharing period CS as a disable period of the first source output enable signal SOE1 to precharge all data lines with an average voltage (i.e., a middle voltage) using electric charges charged in each data line in a previous horizontal period.

Figure 3:
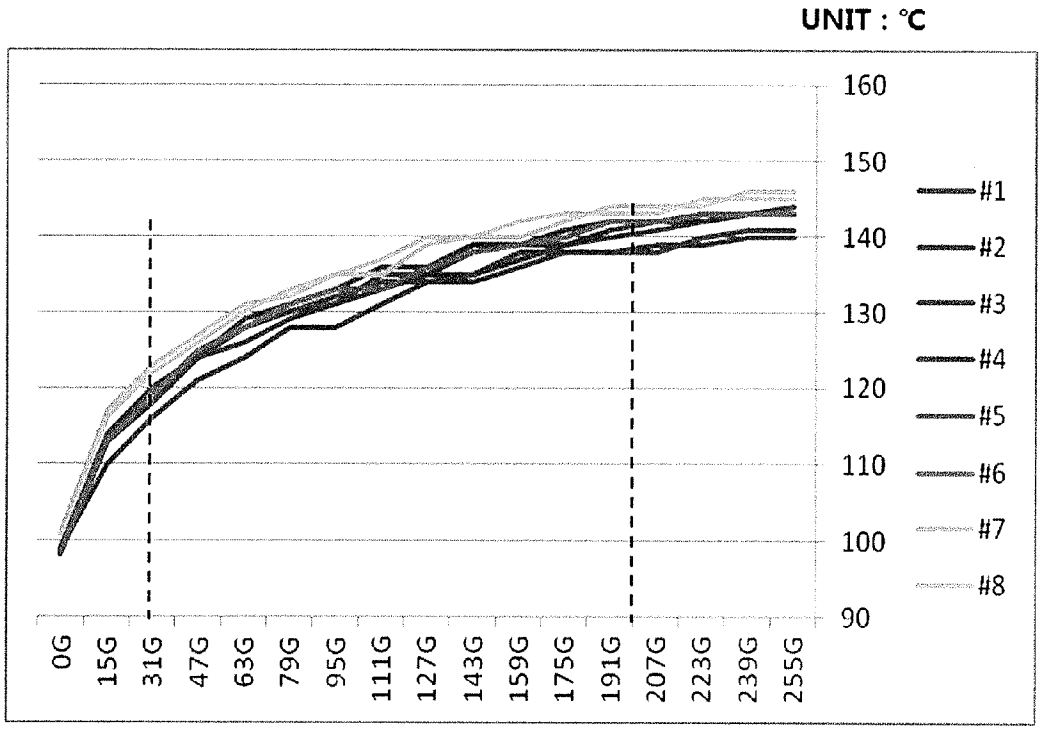
FIG. 3 is a graph illustrating heating temperature characteristic per gray scale in a drive integrated circuit (IC) to which charge sharing is applied according to an embodiment of the present invention.

FIG. 3 is a graph illustrating heating temperature characteristic per gray scale in a drive IC to which charge sharing is applied.

As seen from FIG. 3, a middle voltage point corresponds to a 31 gray scale voltage among 256 gray scales in terms of temperature increase per gray scale. In order to minimize overshoot/undershoot, a 31 gray scale voltage may be set as an optimum precharge voltage in terms of temperature reduction and a precharge voltage may be varied. In each data line, when current data has different polarity from previous data and has a specific gray scale (e.g., a 200 gray scale) or more, the first high level voltage VDD or the second high level voltage FVDD and the low level voltage VSS are used to sufficiently precharge a data line using overshooting/undershooting.

Figure 4:
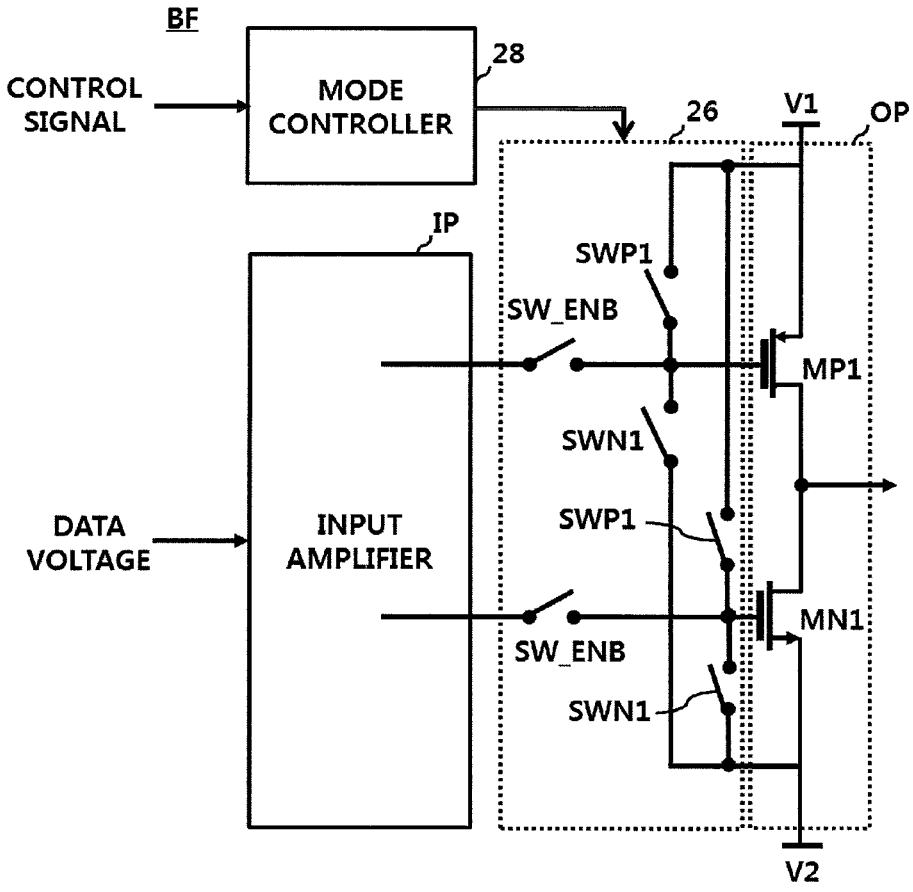
FIG. 4 is a circuit diagram of an internal structure of an output buffer illustrated in FIG. 1 in terms of an output terminal according to an embodiment of the present invention.

FIG. 4 is a circuit diagram of an internal structure of an output buffer BF illustrated in FIG. 1 in terms of an output terminal.

The output buffer BF illustrated in FIG. 4 corresponds to each of the positive output buffer PBF and the negative output buffer NBF illustrated in FIG. 1. In other words, each of the positive output buffer PBF and the negative output buffer NBF have the same structure as the output buffer BF illustrated in FIG. 4 but different voltages are supplied as input voltages V1 and V2 only. Each output buffer BF includes the input amplifier IP, the outputter OP, a control switch unit 26 connected between the input amplifier IP and the outputter OP, and a mode controller 28 for control of the control switch unit 26 according to an input control signal.

The input amplifier IP includes a differential amplifier and a cascade amplifier and amplifies and outputs current corresponding to an input data voltage. The outputter OP outputs a data voltage converging to an input data voltage using amplified current from the input amplifier IP.

The outputter OP includes a first output transistor MP1 for forming a charging path for an output line and a second output transistor MN1 for forming a discharging path, which are connected in series between the first and second voltages V1 and V2. When the output buffer BF is the positive output buffer PBF, one of the first and second high level voltages VDD and FVDD is supplied as the first voltage V1 and the middle level voltage HVDD is supplied as the second voltage V2. When the output buffer BF is the negative output buffer NBF, the middle level voltage HVDD is supplied as the first voltage V1, and the low level voltage VSS is supplied as the second voltage V2.

The control switch unit 26 includes a first control switch SW_ENB connected between a gate of each of the first and second output transistors MP1 and MN1 and an output terminal of the input amplifier IP, a second control switch SWP1 connected between the first voltage V1 and a gate of the first output transistor MP1 and between the first voltage V1 and a gate of the second output transistor MN1, and a third control switch SWN1 connected between the second voltage V2 and a gate of the first output transistor MP1 and between the second voltage V2 and a gate of the second output transistor MN1. The first and second output transistors MP1 and MN1 operate in opposite ways.

The first control switch SW_ENB connects the input amplifier IP and the outputter OP in a data supplying period. In addition, the first control switch SW_ENB also connects the input amplifier IP and the outputter OP during supply of a gray scale voltage as a precharge voltage through the input amplifier IP. For example, during supply of a 31 gray-scale data voltage from the input amplifier IP as a precharge voltage, the first control switch SW_ENB connects the input amplifier IP and the outputter OP.

During precharge of an output line using charging current through the first output transistor MP1, the second control switch SWP1 may connect the first voltage V1 to a gate of the first output transistor MP1 such that the first output transistor MP1 performs a switching operation.

During precharge of an output line using discharging current through the second output transistor MN2, the third control switch SWN1 may connect the second voltage V2 to a gate of the second output transistor MN1 such that the second output transistor MN1 performs a switching operation.

The mode controller 28 selectively controls the first to third control switches SW_ENB, SWP1, and SWN1 of the control switch unit 26 using a control signal input per data channel from a timing controller.

The timing controller determines whether a difference in gray scale (i.e., a data voltage level) between previous data and current data is present per channel. In this case, when the difference in gray scale is present, the timing controller turns on a switching mode of the outputter OP for precharging, and when the difference in gray scale is not present, the timing controller turns off the switching mode of the outputter OP.

In response to a control signal supplied per channel from the timing controller, the mode controller 28 controls the control switch unit 26 per mode according to Table 1 below.

TABLE 1

| The control switch unit 26 | SWP1 | SWN1 | SW_ENB |
|---|---|---|---|
| During drive of MP1 | ON | OFF | OFF |
| During drive of MN1 | OFF | ON | OFF |
| During drive of 31G + MP1 | ON | OFF | ON (SOE1, 31G data) |
| During drive of 31G + MN1 | OFF | ON | ON (SOE1, 31G data) |
| During normal drive | OFF | OFF | ON |

For example, the timing controller analyzes data, and drives the output buffer BF of a corresponding channel in a precharge mode using overshooting or undershooting through a mode control signal when the data has different polarity from previous data and a gray scale of the current data is greater than a predetermined referenced value (e.g., 203 gray scale). Thus, in the precharge period PC of each horizontal line, the positive output buffer PBF of a corresponding channel drives the first output transistor MP1 in a switching mode by the turned-on second control switch SWP1, and the negative output buffer NBF of the corresponding channel drives the second output transistor MN1 in a switching mode by the turned-on third control switch SWN1. In this case, the second high level voltage FVDD as the first voltage V1 is supplied to the positive output buffer PBF.

Figure 5:
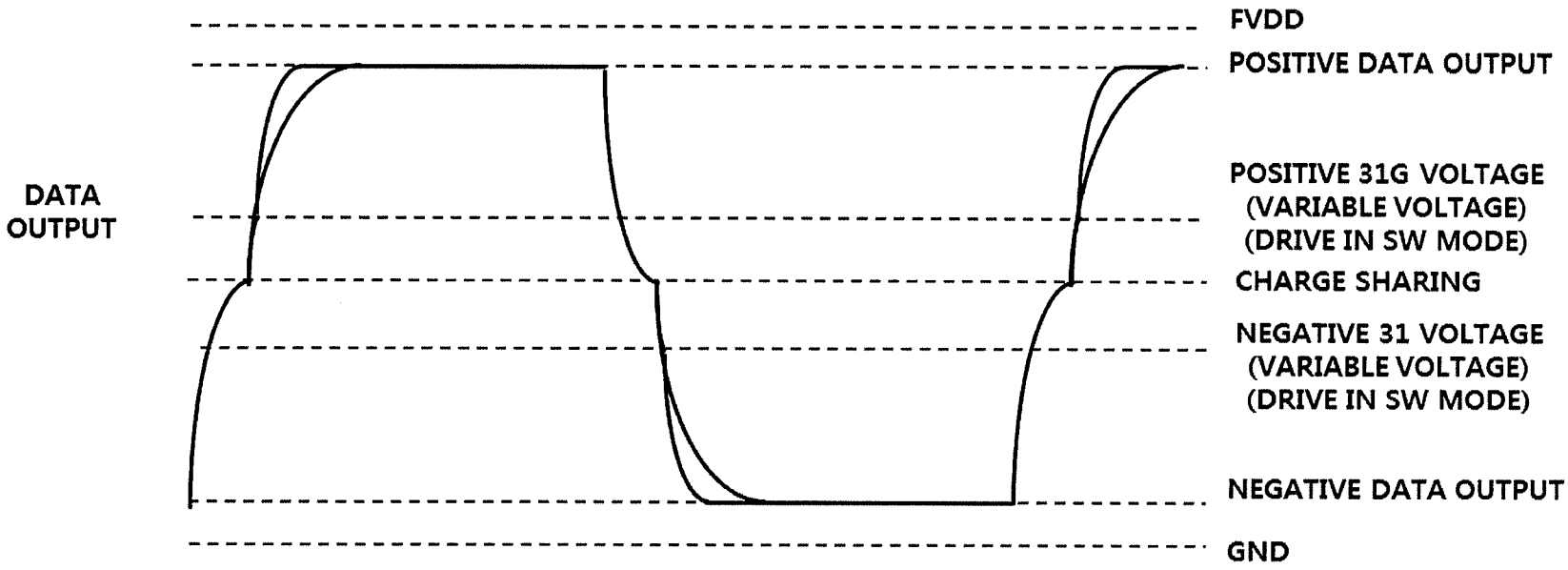
FIG. 5 is an example of a data voltage waveform diagram containing a precharge period using overshooting and undershooting in the output buffer illustrated in FIG. 4.

Accordingly, the first output transistor MP1 of the positive output buffer PBF precharges an output channel with a voltage for overshooting to the second high level voltage VDD using charging current and the second output transistor MN1 of the negative output buffer NBF precharges an output channel with a voltage for undershooting to the low level voltage VSS using discharging current, as illustrated in FIG. 5. As a result, in a next data supplying period DP, a period for charging and discharging with a desired data voltage through the corresponding output buffer BF may be reduced to reduce charging and discharging current, thereby reducing a heating value of the output buffer BF.

In addition, the timing controller analyzes data and drives the output buffer BF of a corresponding channel in a precharge mode using a precharge voltage (a 31 gray scale) through a control signal when the current data has different polarity or level from previous data and a gray scale of the current data is smaller than a predetermined referenced value (e.g., a 203 gray scale). In this case, a 31 gray scale voltage may be supplied to the outputter OP through the first control switch SW_ENB from an input amplifier 22 in a disable period (i.e., a charge sharing period) of the first source output enable signal SOE1. Then in the precharge period PC, the output buffer BF of the corresponding channel drives the first output transistor MP1 in a switching mode by the turned-on second control switch SWP1 or drives the second output transistor MN1 in a switching mode by the turned-on third control switch SWN1.

Figure 6:
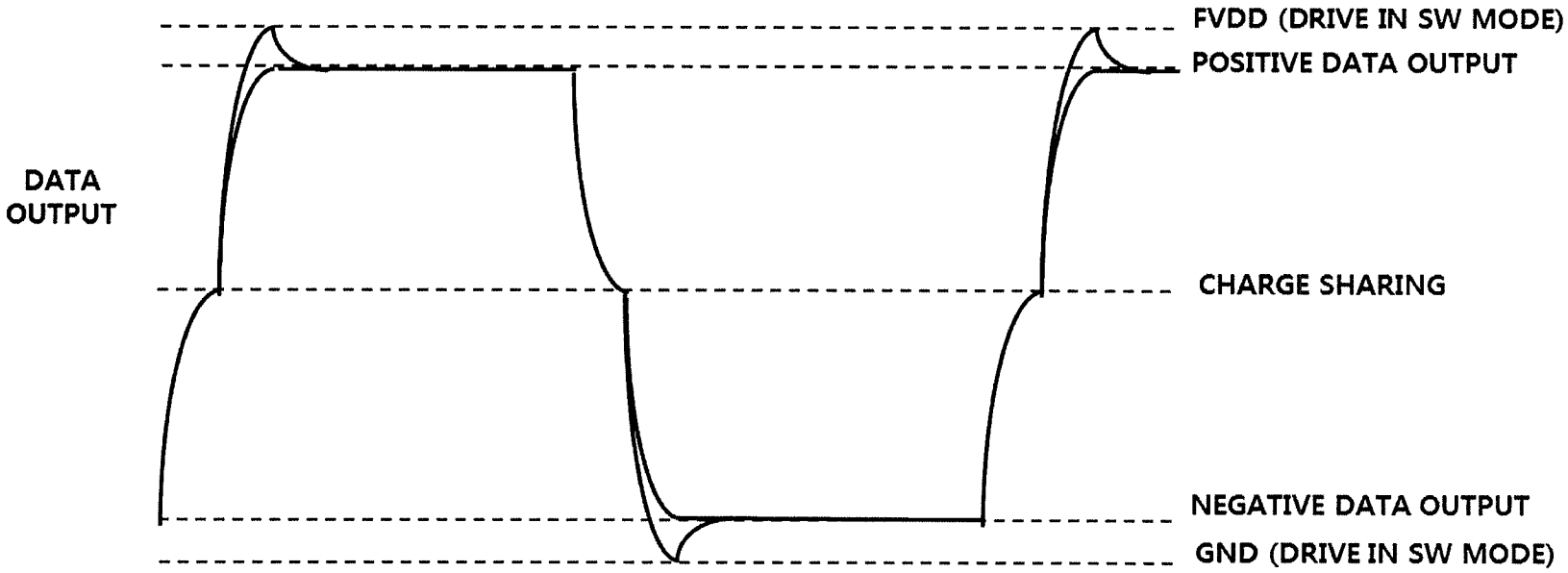
FIG. 6 is an example of a data voltage waveform diagram containing a precharge period using a 30 gray scale voltage in the output buffer illustrated in FIG. 4.

Accordingly, the first output transistor MP1 of the positive output buffer PBF precharges an output channel with a positive 31 gray scale voltage using charging current or discharging current of the second output transistor MN1 and the first output transistor MP1 of the negative output buffer NBF precharges an output channel with a negative 31 gray scale voltage using charging current or discharging current of the second output transistor MN1, as illustrated in FIG. 6. As a result, in the next data supplying period DP, a period for charging and discharging with a desired data voltage may be reduced to reduce charging and discharging current, thereby reducing a heating value of the output buffer BF.

The timing controller analyzes data, and turns off a switching mode of the outputter OP of the corresponding output buffer BF through a mode control signal to drive the outputter OP in a normal driving mode for supplying data immediately after a charge sharing period without a precharge period when previous data and the current data is not different or similar.

Likewise, a data driver according to the present invention may drive only an outputter of an output buffer in a switching mode with respect to only a channel in which a difference in data level is present in response to a control signal from a timing controller, indicating whether a difference in data level is present per channel, thereby reducing charging and discharging current due to an unnecessary switching operation of the outputter.

In addition, the data driver according to the present invention precharges an outputter of an output buffer via overshooting/undershooting using a high level voltage FVDD/low level voltage VSS with respect to a channel to which a specific gray level data or more is supplied and precharges the outputter of the output buffer using an optimal gray scale voltage with respect to a channel to which data less than a specific gray level data is supplied, in response to a control signal from a timing controller, indicating whether a data level has a specific gray scale or more as well as whether a difference in data level is present per channel, so as to reduce a data charging and discharging period of the outputter, thereby reducing charging and discharging current.

Figure 7:
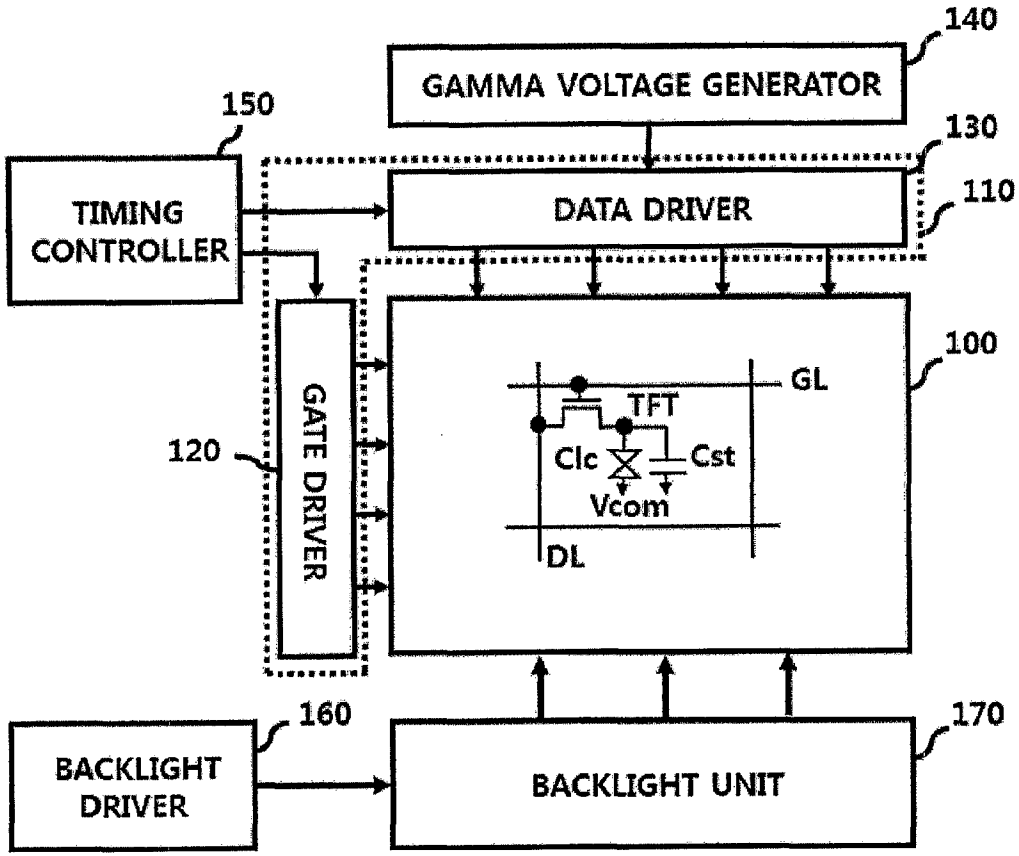
FIG. 7 is a schematic block diagram of a liquid crystal display device according to an embodiment of the present invention.

FIG. 7 is a schematic block diagram of a liquid crystal display device according to an embodiment of the present invention. All the components of the liquid crystal display device are operatively coupled and configured.

The liquid crystal display device shown in FIG. 7 includes a liquid crystal panel 100, a backlight unit 170, a panel driver 110 including a data driver 130 and gate driver 120 for driving the liquid crystal panel 100, a backlight driver 160 for driving the backlight unit 170, and a timing controller 150 for controlling drive of the panel driver 110 and the backlight driver 160.

The timing controller 150 inputs a plurality of synchronization signals together with image data supplied from an external host computer. The plural synchronization signals include at least a dot clock and a data enable signal and further include a horizontal synchronization signal and a vertical synchronization signal. The timing controller 150 corrects data input from a host set 10 using various data processing methods for increasing image quality and reducing power consumption to output the data to the data driver 130 of the panel driver 110. For example, in order to a response speed of liquid crystal, the timing controller 150 may apply an overshoot or undershoot value selected from a lookup table according to a data difference between adjacent frames and may correct the input data into overdriving data to output the overdriving data.

In order to increase a contrast ratio or to reduce power consumption, the timing controller 150 may analyze brightness of the input data, may output a diming signal for drive of brightness of the backlight unit 170 to the backlight driver 160, and may also correct and output the data.

The timing controller 150 generates a data control signal for control of drive timing of the data driver 130 and a gate control signal for control of drive timing of the gate driver 120 using the input synchronization signals. When the synchronization signal from the host set 10 includes a dot clock signal and a data enable signal, the timing controller 150 may generate and use a horizontal synchronization signal and a vertical synchronization signal Vsync via frequency analysis of the input data using the dot clock and the data enable signal.

The timing controller 150 supplies the data control signal and the gate control signal to the data driver 130 and the gate driver 120, respectively. The data control signal includes a source start pulse and source sampling clock for controlling latch of a data signal, a polarity control signal for controlling polarity of the data signal, first and second source output enable signals SOE1 and SOE2 for controlling a supply period, charge sharing period, and precharge period of the data signal, and the like. The gate control signal includes a gate start pulse and gate shift clock for control of scanning of a gate signal, a gate output enable signal for control of an output period of the gate signal, and the like. In addition, the timing controller 150 supplies the vertical synchronization signal Vsync to the backlight driver 160 for synchronization of the liquid crystal panel 100 and the backlight unit 170.

The timing controller 150 analyzes data to be supplied to a plurality of channels (data lines) through the data driver 130 per channel, generates a control signal indicating whether a difference in data level is present per channel or indicating whether a data level has a specific gray scale or more as well as whether a difference in data level is present per channel, and outputs the control signal to the data driver 130.

Figure 8:
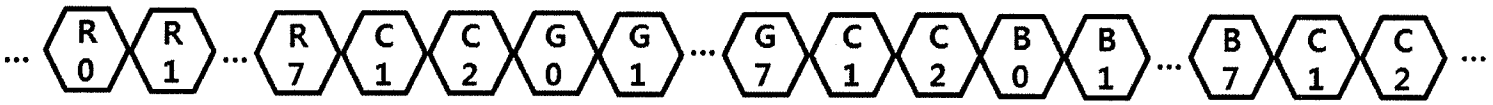
FIG. 8 is an example of a waveform diagram illustrating image data and control data supplied to a data driver from the timing controller illustrated in FIG. 7.

As illustrated in FIG. 8, the timing controller 150 adds control signals C1 and C2 to R/G/B sub pixel data and supplies the R/G/B sub pixel data to the data driver 130.

The panel driver 110 includes the data driver 130 for driving a data line DL formed on a thin film transistor array of the liquid crystal panel 100 and the gate driver 120 for driving a gate line GL formed on a thin film transistor array of the liquid crystal panel 100.

The data driver 130 supplies image data from the timing controller 150 to a plurality of data lines DL of the liquid crystal panel 100 in response to a data control signal from the timing controller 150. The data driver 130 converts digital data input from the timing controller 150 into a positive/negative data signal using a gamma voltage from a gamma voltage generator 140 and supplies a data signal to the data line DL whenever each gate line GL is driven.

In particular, the data driver 130 may drive only an outputter of an output buffer in a switching mode with respect to only a channel in which a difference in data level is present in response to a control signal from a timing controller, indicating whether a difference in data level is present per channel, thereby reducing charging and discharging current due to an unnecessary switching operation of the outputter.

In addition, the data driver 130 precharges an outputter of an output buffer via overshooting/undershooting using a high level voltage FVDD/low level voltage VSS with respect to a channel to which a specific gray level data or more is supplied and precharges the outputter of the output buffer using an optimal gray scale voltage with respect to a channel to which data less than a specific gray level data is supplied, in response to a control signal from a timing controller, indicating whether a data level has a specific gray scale or more as well as whether a difference in data level is present per channel, so as to reduce a data charging and discharging period of the outputter, thereby reducing charging and discharging current.

The data driver 130 may include at least one data IC, may be mounted on a circuit film such as a tape carrier package (TCP), a chip on film (COF), a flexible printed circuit (FPC), or the like, and may be attached to the liquid crystal panel 100 using a tape automatic bonding (TAB) method or may be mounted on the liquid crystal panel 100 using a chip on glass (COG) method.

The gate driver 120 sequentially drives gate lines GLs of the liquid crystal panel 100 in response to the gate control signal from the timing controller 150. The gate driver 120 supplies a scan pulse of a gate-on voltage to each gate line GL every corresponding scan period and supplies a gate-off voltage for the remaining period when the other gate lines GLs are driven. The gate driver 120 may include at least one gate IC, may be mounted on a circuit film such as a TCP, a COF, a FPC, or the like, and may be attached to the liquid crystal panel 100 using a TAB method or may be mounted on the liquid crystal panel 100 using a COG method. On the other hand, the gate driver 120 may be formed on a TFT substrate together with the TFT array using the same process and may be internally installed in the liquid crystal panel 100 using a gate in panel (GIP) method.

The liquid crystal panel 100 includes a color filter substrate on which a color filter array is formed, a thin film transistor (TFT) substrate on which a TFT array is formed, a liquid crystal layer between the color filter substrate and the TFT substrate, and polarizing plates attached to external surfaces of the color filter substrate and TFT substrate. The liquid crystal panel 100 displays an image through a pixel matrix on which a plurality of pixels is arranged. Each pixel implements desired color by combinations of red R, green G, and blue B sub-pixels which adjust optical transmittance using variation in liquid crystal arrangement according to a data signal and further includes a white W sub-pixel for enhancement of brightness. Each sub-pixel includes a thin film transistor TFT connected to the gate line GL and the data line DL, and a liquid crystal capacitor Clc and a storage capacitor Cst that are connected in parallel to the thin film transistor TFT. The liquid crystal capacitor Clc is charged with a difference voltage between a voltage of the data signal applied to a pixel electrode through the thin film transistor TFT and a common voltage Vcom applied to a common electrode, and drives liquid crystal according to the charged voltage to adjust optical transmittance. The storage capacitor Cst stably maintains the voltage charged in the liquid crystal capacitor Clc. The liquid crystal layer is driven by a vertical magnetic field, for example, in a twisted nematic (TN) mode or a vertical alignment (VA) mode or by a horizontal magnetic field, for example, in an in-plane switching (IPS) mode or a fringe field switching (FFS) mode.

The backlight unit 170 may use a direct type or edge type backlight including, as a light source, a fluorescent lamp driven by the backlight driver 160, such as a cold cathode fluorescent lamp (CCFL), an external electrode fluorescent lamp (EEFL), or the like, or a light emitting diode (LED). The direct type backlight includes light sources that are arranged over an entire display region so as to face a bottom surface of the liquid crystal panel 100 and a plurality of optical sheets arranged over the light sources, and is configured in such a way that light emitted from the light sources is irradiated to the liquid crystal panel 100 through the plurality of optical sheets. The edge type backlight includes a light guide plate facing the bottom surface of the liquid crystal panel 100, a light source disposed to face at least one edge of the light guide plate, and a plurality of optical sheets disposed on the light guide plate, and is configured in such a way that light emitted from the light source is converted into light of a surface light source and is irradiated to the liquid crystal panel 100 through the plurality of optical sheets.

The backlight driver 160 drives the backlight unit 170 and also controls brightness of the backlight unit 170 in response to a dimming signal from a host computer or the timing controller 150. When the backlight unit 170 is divided into a plurality of regions and is driven, a plurality of backlight drivers 160 may be used to independently drive the plural regions.

As described above, a liquid crystal display device and a method of driving the same according to one or more embodiments of the present invention may drive only an outputter of an output buffer in a switching mode with respect to only a channel in which a difference in data level is present in response to a control signal from a timing controller, indicating whether a difference in data level is present per channel, thereby reducing charging and discharging current due to an unnecessary switching operation of the outputter.

In addition, the liquid crystal display device and the method of driving the same according to one or more embodiments of the present invention may precharge an outputter of an output buffer via overshooting/undershooting using a high level voltage FVDD/low level voltage VSS with respect to a channel to which a specific gray level data or more is supplied and precharge the outputter of the output buffer using an optimal gray scale voltage with respect to a channel to which data less than a specific gray level data is supplied, in response to a control signal from a timing controller, indicating whether a data level has a specific gray scale or more as well as whether a difference in data level (polarity) is present per channel, so as to minimize a data charging and discharging period of the outputter, thereby reducing output current.

As a result, in the liquid crystal display device and the method of driving the same according to the present invention, even if a high resolution and large size liquid crystal panel is developed, a heating temperature of a drive IC may be reduced, thereby ensuring the reliability of the drive IC.

As described above, the liquid crystal display device according to one or more embodiments of the present invention may drive only an outputter of an output buffer in a switching mode with respect to only a channel in which a difference in data level is present in response to a control signal from a timing controller, indicating whether a difference in data level is present per channel, thereby reducing charging and discharging current due to an unnecessary switching operation of the outputter.

In addition, the liquid crystal display device according to one or more embodiments of the present invention may precharge an outputter of an output buffer via overshooting/undershooting using a high level voltage FVDD/low level voltage VSS with respect to a channel to which a specific gray level data or more is supplied and precharge the outputter of the output buffer using an optimal gray scale voltage with respect to a channel to which data less than a specific gray level data is supplied, in response to a control signal from a timing controller, indicating whether a data level has a specific gray scale or more as well as whether a difference in data level is present per channel, so as to minimize a data charging and discharging period of the outputter, thereby reducing output current.

As a result, in the liquid crystal display device and the method of driving the same according to one or more embodiments of the present invention, even if a high resolution and large size liquid crystal panel is developed, a heating temperature of a drive IC may be reduced, thereby ensuring the reliability of the drive IC.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A data driving apparatus for a liquid crystal display device, the data driving apparatus comprising:

an output buffer configured to buffer and output a data voltage input from a digital-analog converter, wherein the output buffer comprises:

an input amplifier configured to amplify and output current proportional to the data voltage;

an outputter configured to supply the data voltage corresponding to an input data voltage to an output channel using charging and discharging current proportional to the output current from the input amplifier, the outputter including a first output transistor for forming a charging path between a first voltage and the output channel, and a second output transistor for forming a discharging path between a second voltage and the output channel, the second voltage being lower than the first voltage;

a control switch unit connected between the input amplifier and the outputter, and configured to drive the outputter in a switching mode to precharge the output channel in a precharge period prior to a data supplying period in which the outputter outputs the data voltage, the control switch including a first control switch connected between first and second output lines of the input amplifier and a gate of the first and second output transistors, for selectively connecting the input amplifier and the outputter in the data supplying period; and a mode controller configured to control the control switch unit in response to an input control signal; and a timing controller configured to analyze data to be supplied to the output channel per output channel, and generate and output the input control signal for controlling a switching mode of the outputter according to whether a difference in a data voltage level is present or the data voltage level satisfies a specific gray scale condition per output channel.

2. The data driving apparatus according to claim 1, wherein:

the control switch unit further comprises:

a second control switch connected between the first voltage and a gate of the first output transistor and between the first voltage and a gate of the second output transistor, for controlling the first and second output transistors so as to precharge the output channel through the charging path in the precharge period, and a third control switch connected between the second voltage and a gate of the first output transistor and between the second voltage and a gate of the second output transistor, for controlling the first and second output transistors so as to precharge the output channel through the discharging path in the precharge period.

3. The data driving apparatus according to claim 1, wherein the mode controller turns off the switching mode of the outputter when the input control signal indicates that the difference in the data voltage level is not present, and turns on the switching mode of the outputter when the input control signal indicates that the difference in the data voltage level is present.

4. The data driving apparatus according to claim 3, wherein the outputter is controlled to precharge the output channel via overshooting using the first voltage or undershooting using the second voltage when the input control signal indicates that the difference in data voltage level is present and a gray scale of data to be supplied to the output channel is a specific gray scale or more.

5. The data driving apparatus according to claim 4, wherein the outputter is controlled to precharge the output channel with any one of gray scale voltages supplied through the input amplifier when the input control signal indicates that the difference in data voltage level is present and a gray scale of data to be supplied to the output channel is a gray scale less than the specific gray scale.

6. The data driving apparatus according to claim 5, wherein:

the timing controller generates and outputs first and second enable signals;

the first control switch supplies a gray scale voltage from the input amplifier to the outputter in a disable period of the first output enable signal; and the second or third control switch precharges the output channel with the gray scale voltage supplied from the input amplifier in a disable period of the second output enable signal.

7. A data driving apparatus for a liquid crystal display device, the data driving apparatus comprising:

an output buffer configured to buffer and output a data voltage input from a digital-analog converter, wherein the output buffer comprises:

an input amplifier configured to amplify and output current proportional to the data voltage;

an outputter configured to supply the data voltage corresponding to an input data voltage to an output channel using charging and discharging current proportional to the output current from the input amplifier;

a control switch unit connected between the input amplifier and the outputter, and configured to drive the outputter in a switching mode to precharge the output channel in a precharge period prior to a data supplying period in which the outputter outputs the data voltage; and a mode controller configured to control the control switch unit in response to an input control signal; and a timing controller for analyzing data to be supplied to the output channel per output channel, and generating and outputting the input control signal for controlling a switching mode of the outputter according to whether a difference in a data voltage level is present or the data voltage level satisfies a specific gray scale condition per output channel, wherein:

the outputter comprises: a first output transistor for forming a charging path between a first voltage and the output channel; and a second output transistor for forming a discharging path between a second voltage lower than the first voltage and the output channel; and the control switch unit comprises:

a first control switch connected between first and second output lines of the input amplifier and a gate of the first and second output transistors, for connecting the input amplifier and the outputter in the data supplying period, a second control switch connected between the first voltage and a gate of the first output transistor and between the first voltage and a gate of the second output transistor, for controlling the first and second output transistors so as to precharge the output channel through the charging path in the precharge period, and a third control switch connected between the second voltage and a gate of the first output transistor and between the second voltage and a gate of the second output transistor, for controlling the first and second output transistors so as to precharge the output channel through the discharging path in the precharge period.

* * * * *